US011464296B2

(12) United States Patent
Martin

(10) Patent No.: US 11,464,296 B2
(45) **Date of Patent: *Oct. 11, 2022**

(54) SLIDABLE BUTTON ON A MONORAIL TRACK FOR TIGHTENING AND LOOSENING OF A GARMENT

(71) Applicant: Eric Lee Martin, Playa Vista, CA (US)

(72) Inventor: Eric Lee Martin, Playa Vista, CA (US)

(73) Assignee: Eric Lee Martin

( * ) Notice: Subject to any disclaimer, the term of this patent is extended or adjusted under 35 U.S.C. 154(b) by 180 days.

This patent is subject to a terminal disclaimer.

(21) Appl. No.: 16/697,925

(22) Filed: Nov. 27, 2019

(65) Prior Publication Data

US 2020/0093227 A1 Mar. 26, 2020

Related U.S. Application Data

(63) Continuation-in-part of application No. 15/925,461, filed on Mar. 19, 2018, now Pat. No. 10,681,947.

(60) Provisional application No. 62/473,969, filed on Mar. 20, 2017.

(51) Int. Cl.
*A44B 1/38* (2006.01)

(52) U.S. Cl.
CPC ..... *A44B 1/38* (2013.01)

(58) Field of Classification Search
CPC .... A44B 1/38; A44B 1/26; A44B 1/28; A44B 1/32; A44B 1/40; A44B 1/18; A44B 11/20; A44B 11/24; A44B 11/2557; A44B 17/0011; A44B 19/30; A44B 19/308; A44B 19/306; A41F 1/008; A41F 9/002; A41F 9/005; A41F 9/025; Y10T 24/2142; Y10T 24/2187; Y10T 24/2155; Y10T 24/42; A44C 5/2028; A44C 5/2066; A43C 11/12; A43C 11/14
See application file for complete search history.

(56) References Cited

U.S. PATENT DOCUMENTS

| | | | |
|---|---|---|---|
| 1,965,315 | A | 7/1934 | Mainzer |
| 2,913,157 | A | 11/1959 | Crohn |
| 4,916,779 | A | 4/1990 | Terada et al. |
| 4,976,017 | A | 12/1990 | Frano |
| 2005/0102802 | A1 | 5/2005 | Sitbon et al. |

(Continued)

FOREIGN PATENT DOCUMENTS

| | | | |
|---|---|---|---|
| DE | 268652 | C | 12/1913 |
| DE | 321203 | C | 5/1920 |

(Continued)

*Primary Examiner* — Katherine M Moran
*Assistant Examiner* — Erick I Lopez
(74) *Attorney, Agent, or Firm* — Plager Schack LLP; Mark H. Plager; Kara Verryt

(57) ABSTRACT

A device for adjusting the fit of a garment may include a monorail track with a plurality of rail teeth spaced along a length thereof; a rail carriage slidably engaged with the monorail track; and a button operatively attached to the rail carriage, wherein at least one of the rail carriage and the button includes a locking device to removably engage with the plurality of track teeth. The locking device may be a trigger post with a button tooth, an engagement pin, a pinch clamp, a leaf spring, or the like. Size adjustment of a garment may be accomplished by sliding the button to a desired position of the monorail track and locking the button into place with the locking device.

10 Claims, 8 Drawing Sheets

(56) References Cited

U.S. PATENT DOCUMENTS

| | | | | |
|---|---|---|---|---|
| 2010/0011542 | A1 | 1/2010 | Badrenas Buscart | |
| 2013/0117987 | A1* | 5/2013 | Rienecker | A41F 9/002 2/311 |
| 2014/0304892 | A1 | 10/2014 | Schneider | |
| 2015/0014463 | A1 | 1/2015 | Converse et al. | |
| 2015/0272249 | A1 | 10/2015 | Glenn | |
| 2015/0289600 | A1* | 10/2015 | Shirai | A44B 11/24 24/303 |
| 2016/0015136 | A1* | 1/2016 | Yue | A44C 5/0015 63/1.11 |
| 2017/0006949 | A1 | 1/2017 | Lacy et al. | |
| 2018/0263322 | A1 | 9/2018 | Martin | |

FOREIGN PATENT DOCUMENTS

| | | | |
|---|---|---|---|
| KR | 101573617 | B1 | 12/2015 |
| WO | 2016138895 | A1 | 9/2016 |

* cited by examiner 18
34
24
28
26
34

18
24
28
37
35
26

18
34
30
24
30
28
37
35
30
34

18
34
30
24
35
28
37
30
34

SLIDABLE BUTTON ON A MONORAIL TRACK FOR TIGHTENING AND LOOSENING OF A GARMENT

RELATED APPLICATION

This application is a continuation of and claims priority to non-provisional patent application U.S. Ser. No. 15/925,461 filed on Mar. 19, 2018, the entire contents of which is herein incorporated by reference.

BACKGROUND

The embodiments herein relate generally to clothing, and more particularly, to a button slidably engaged with a track for adjusting the size of a garment.

Conventional buttons are designed to engage with a buttonhole. Thus, unless there are multiple buttonhole options, a conventional button only provides the ability to have clothing fit at one sizing. Unfortunately, many individuals do not perfectly fit a predefined size. For example, if a male is buying pants and has a size 35 waist, a 34 may be too tight and a 36 may be too big. As a result, he is required to choose a pair of pants that does not fit him quite correctly. Moreover, a user's waist size may vary over the course of a day, week, month, or year. Lastly, production runs can be inconsistent when producing a particular size and can vary up to ½", meaning that a first pair of pants from a particular production run may fit slightly different than a second pair of pants from a particular production run. This can be even more problematic when comparing one brand's size to the same size in a different brand, making purchasing different brands of a similar item of clothing frustrating. However, conventional clothing does not include adjustable fasteners to provide for adjustments, such as fine tune adjustments, to the clothing Therefore, what is needed is a fastener that allows for customization or adjustment of sizes, wherein the fastener comprises a button designed to slide along a monorail track and removably lock into a desired location on the track to create adjustable sizing of the garment.

SUMMARY

Some embodiments of the present disclosure include a device for adjusting the fit of a garment. The device may include a monorail track with a plurality of rail teeth spaced along a length thereof; a rail carriage slidably engaged with the monorail track; and a button operatively attached to the rail carriage, wherein at least one of the rail carriage and the button includes a locking device to removably engage with the plurality of track teeth. The locking device may be a trigger post with a button tooth, an engagement pin, a pinch clamp, a leaf spring, magnets, or the like. Size adjustment of a garment may be accomplished by sliding the button to a desired position of the monorail track and locking the button into place with the locking device.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a garment fastener providing for adjustable sizes and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

a. Button b. Monorail Track

The various elements of the device of the present disclosure may be related in the following exemplary fashion. It is not intended to limit the scope or nature of the relationships between the various elements and the following examples are presented as illustrative examples only.

Figure 1B:
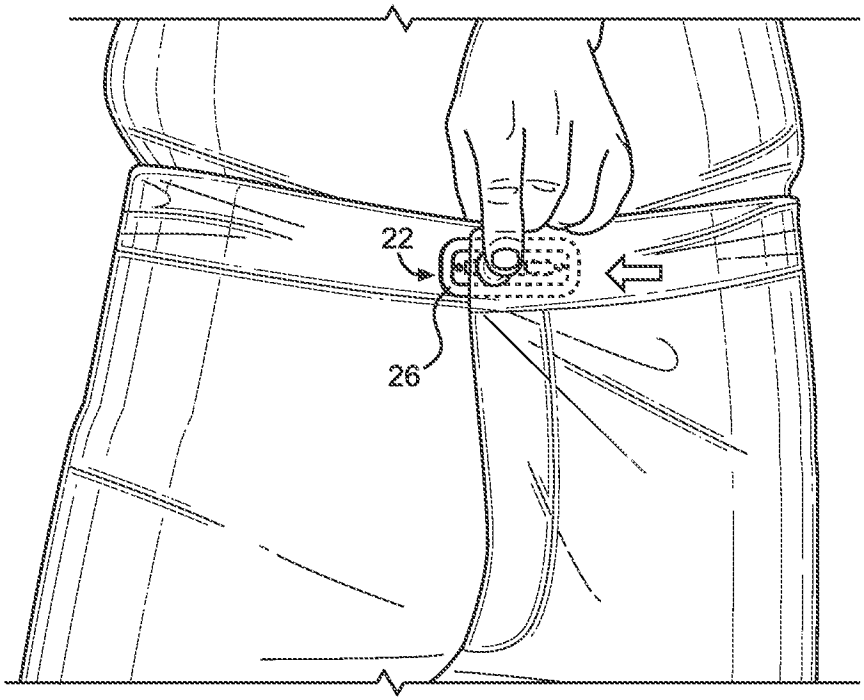
FIG. 1B is a perspective view of one embodiment of the present disclosure, shown in use with the button tightened.
Figure 1A:
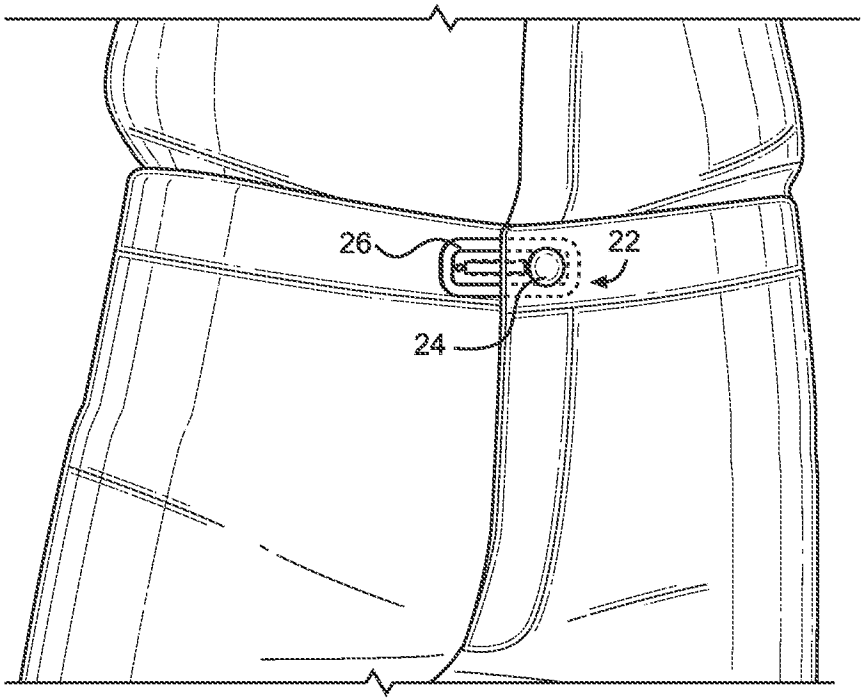
FIG. 1A is a perspective view of one embodiment of the present disclosure, shown in use with the button loosened.

By way of example, and referring to FIGS. 1A-8D, some embodiments of the present disclosure include a device for adjusting the fit of a garment, the device comprising a monorail track 26 comprising an elongate rail, and a button 24 designed to slide along the monorail track 26 and removably lock into place at any desired position along a length of the monorail track 26. As shown in FIGS. 1A and 1B, the device may be incorporated into a garment, such as a pair of pants, wherein the device may replace a conventional button and allow for the garment to have an adjustable fit. There are various ways that the device may be mounted to or incorporated within the garment. For example, the monorail track may be attached to the garment, such as the waistband, using any conventional fastener, such as mounting screws or cap posts that extend into mounting orifices 34 on the monorail. Alternatively, as shown in FIG. 8A, the monorail may have a wing 42 extending from outer edges thereof, wherein the wing 42 may be sewn, adhered, or otherwise attached to the fabric. In some embodiments, the device may be nestled or sandwiched between two layers of fabric, wherein the top layer has a slit with a length similar to that of the monorail track 26 through which the button 24 extends.

Additionally, in embodiments, the garment, such as pants, may include a rear fly with a zipper. However, the zipper may be spaced from the waistband to allow for the monorail track 26 and button 24. Additionally, the front fly designed to cover the monorail track 26 and zipper may include excess fabric such that the monorail track 26 and zipper are covered by the front fly regardless of the button's position on the monorail track 26. The zipper may stop shy of the waistband, such that it stays zipped during any track button movement or action.

The button 24 and the monorail track 26 may each have any suitable structure that allows the button 24 to slide along the length of the monorail track 26 and removably lock into place at the desired location along the monorail track 26.

Figure 2A:
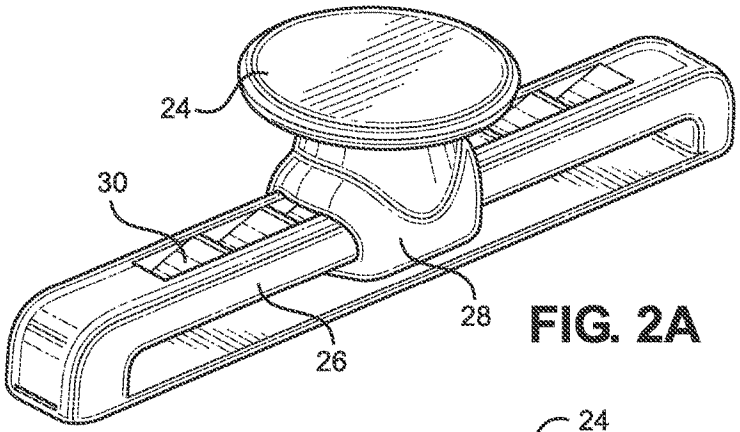
FIG. 2A is a perspective view of a first embodiment of the present disclosure.
Figure 2B:
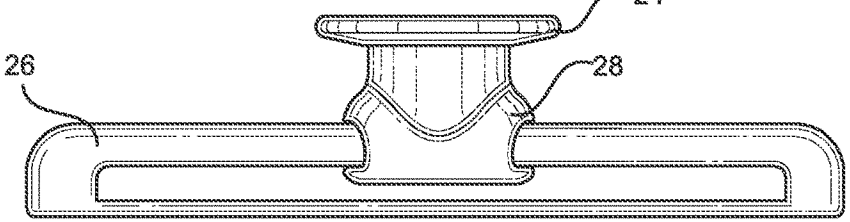
FIG. 2B is a side view of a first embodiment of the present disclosure.
Figure 2C:
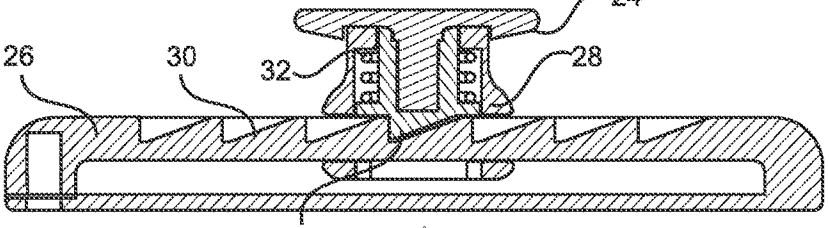
FIG. 2C is a cross-sectional view of a first embodiment of the present disclosure, showing button engagement.
Figure 2D:
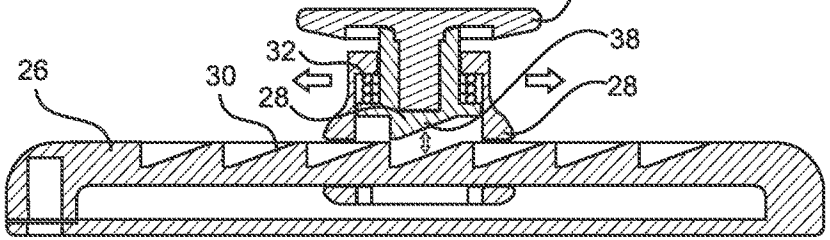
FIG. 2D is a cross-sectional view of a first embodiment of the present disclosure, showing the button lifted.

For example, and as shown in FIGS. 2A-2D, a first embodiment of device for adjusting the fit of a garment comprises a monorail track 26 and a button 24 operatively attached to a rail carriage 28, wherein the rail carriage 28 is slidably engaged with the monorail track 26. The rail carriage 28 may include an orifice through which the monorail track 26 extends. A top surface of the monorail track 26 may include a plurality of monorail teeth 30 built therein, wherein the monorail teeth 30 may include an angled slope and a wall that extends perpendicularly downward from the angled slope to the bottom of the adjacent angled slope. As shown in FIGS. 2C and 2D, the button 24 may comprise a top button surface and a downward extension protruding therein, wherein the downward extension may be positioned within a trigger post 38, wherein an end of the trigger post distal from the top button surface may comprise a button tooth designed and sized to engage with the monorail teeth 30. The rail carriage 28 may encircle the monorail track 26 and extend upwards toward the top surface of the button 24. In embodiments, the rail carriage 28 may be a substantially cylindrical hollow piece with a flared out bottom proximate to the monorail track 26. At the location where the rail carriage 26 approaches the bottom of the top surface of the button 24, the rail carriage 26 may have a lip that extends inwards toward a center of the rail carriage 26, wherein the inner diameter of the lipped edge is sized to accommodate the button extension therein. As shown in the Figures, the trigger post 38 may comprise a sleeve designed to surround the button extension, wherein the button tooth may extend from the distal end of the sleeve. An outer diameter of the trigger post 38 may decrease moving away from the monorail track 26, such that there is a cavity present between the inner diameter of the rail carriage 28 and the outer diameter of the trigger post 38. A spring 32, such as a compression spring, may be positioned within this cavity, wherein the compression spring 32, when in a relaxed state, causes the trigger post 38 to press downward toward the monorail track 26, thus causing the button tooth to press down onto and engage with a rail tooth 30 on the monorail track 26. When the button top 24 is pulled away from the monorail track 26, a lip on a lower part of the trigger post 38 proximate to the monorail track 26 pushes up on and compresses the spring 32, allowing the button tooth to disengage with the rail tooth 30 and, ultimately, allowing the button 24 to slide along a length of the monorail track 26 to the desired location.

Figure 3A:
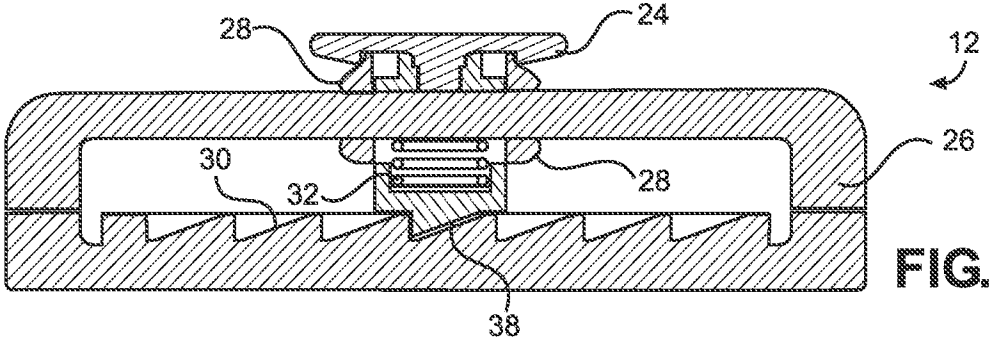
FIG. 3A is a cross-sectional view of a second embodiment of the present disclosure, showing button engagement.
Figure 3B:
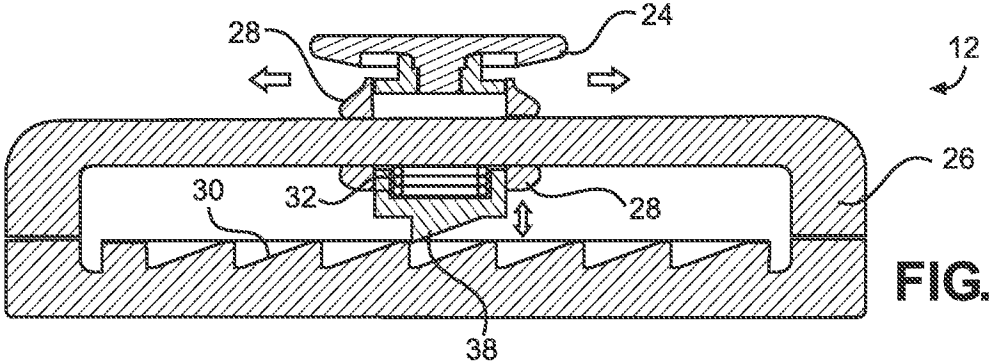
FIG. 3B is a cross-sectional view of a second embodiment of the present disclosure, showing the button lifted.

A second embodiment 12 of the device may again include a button 24 operatively attached to a rail carriage 28 designed to slide along a monorail track 26 and lock into place; however the button 24 may lock into place by removably engaging with teeth 30 spaced from the monorail track 26. For example, and as shown in FIGS. 3A and 3B, the monorail track 26 may be spaced from and substantially parallel to a row of teeth 30, wherein the teeth 30 have a similar structure as those in the first embodiment 10. While the button 24 is still operatively attached to a rail carriage 28 that is capable of sliding along a length of the monorail track 26, the spring 32 is positioned between the monorail track 26 and the row of teeth 30. Again, the button 24 may be operatively attached to a trigger post 38 with a button tooth 38 extending from a distal end thereof in such a manner that, when the button head is pulled away from the monorail track 26, the trigger post 38 may also move away from the row of teeth 30, causing the button tooth to disengage from the row of teeth 30, and thus allowing the button 24 and rail carriage 28 to slide along the length of the monorail track 26. Specifically, pulling the button head away from the monorail track 26 may cause the trigger 38 to compress a spring 32. When the button head is not pulled away from the monorail track 26, the spring 32 may relax and press the button tooth 38 into the row of teeth 30, ultimately locking the button 24 in the desired location.

Figure 4A:
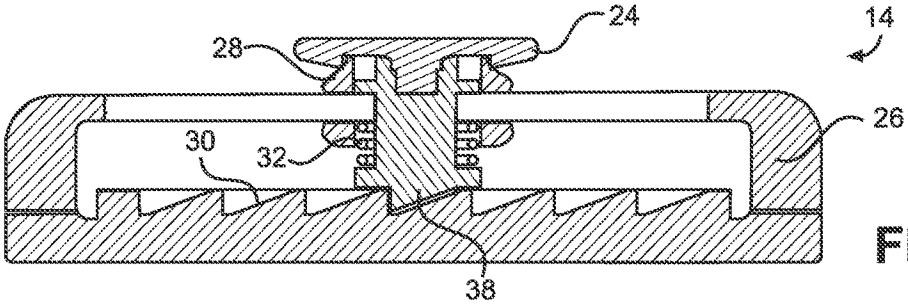
FIG. 4A is a cross-sectional view of a third embodiment of the present disclosure, showing button engagement
Figure 4B:
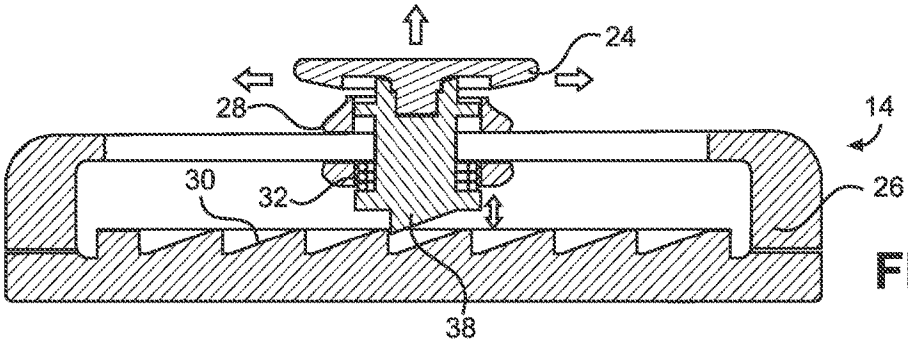
FIG. 4B is a cross-sectional view of a third embodiment of the present disclosure, showing the button lifted.
Figure 4C:
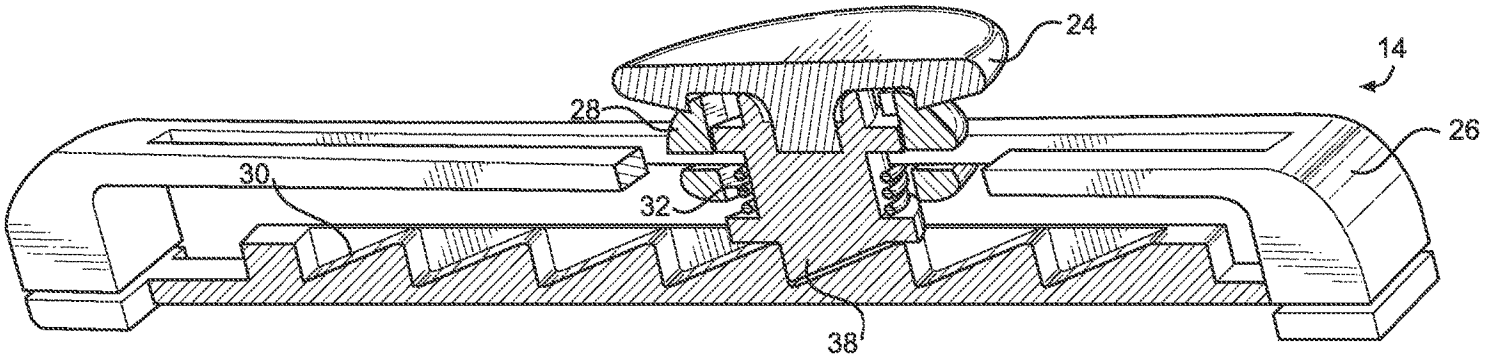
FIG. 4C is a partial cross-sectional view of a third embodiment of the present disclosure.
Figure 5A:
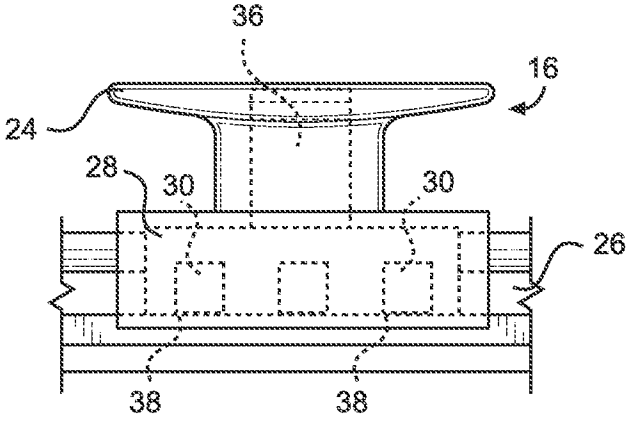
FIG. 5A is a side view of a fourth embodiment of the present disclosure, showing clamp engagement.
Figure 5B:
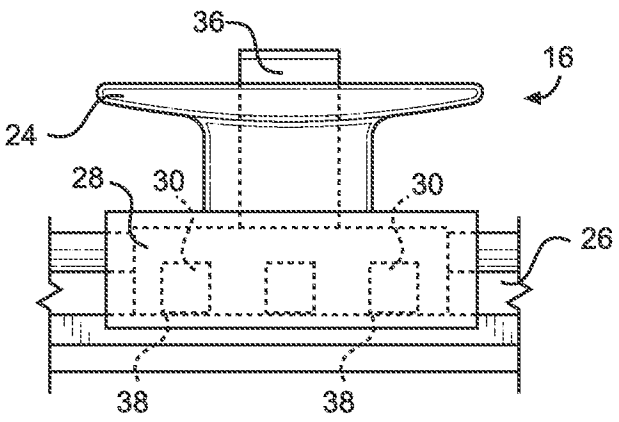
FIG. 5B is a side view of a fourth embodiment of the present disclosure, showing the clamp loosened.
Figure 5C:
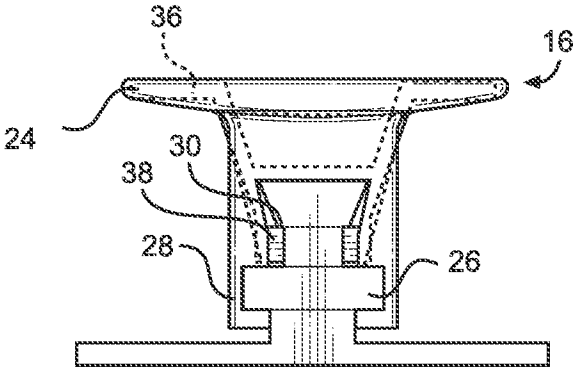
FIG. 5C is a front view of a fourth embodiment of the present disclosure, showing clamp engagement.
Figure 5D:
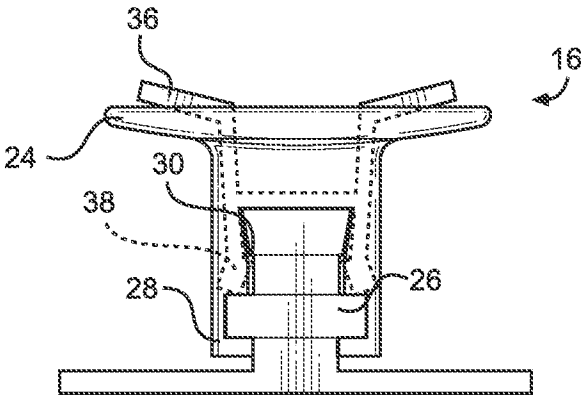
FIG. 5D is a front view of a fourth embodiment of the present disclosure, showing the clamp loosened.

As shown in FIGS. 4A-4C, a third embodiment 14 of the device may include a button 24 operatively attached to a rail carriage 28 designed to slidably engage with a split-rail monorail track 26. The split-rail monorail track 26 may comprise an elongate track with an orifice extending through a central portion of the elongate track and substantially the entire length of the track. Similar to the second embodiment, the monorail track 26 may be spaced from and substantially parallel to a row of teeth 30. The button 24 may comprise a button head and a button extension protruding downward from the button head, wherein the button extension may be operatively attached to a trigger post 38, wherein a distal end of the trigger post 38 may comprise a button tooth designed and sized to removably engage with the teeth 30. The trigger post 38 may extend through the split in the rail from an area proximate to the row of teeth 30 up to the button head. The trigger post 38 may include a lipped edge extending outward from the center of the trigger post 38, wherein the lipped edge is positioned proximate to the button tooth. The rail carriage 28 may encircle the split monorail track 26 and the trigger post 38, wherein the rail carriage 28 has an inner diameter larger than an outer diameter of the trigger post 38, creating a cavity between the rail carriage 28 and the trigger post 38 between the split monorail track 26 and the row of teeth 30, such that a spring 32 may be positioned within the cavity. Similar to the first two embodiments, when the button head 24 is pulled away from the split monorail track 26, the spring 32 may compress, allowing the tooth on the trigger post 38 to disengage with the row of teeth 30 and allowing the rail carriage 28 to slide along a length of the monorail track 26. When the button head 24 is released, the spring 32 presses the lipped edge on the trigger post toward the row of teeth, causing the trigger post tooth to engage with a tooth on the row of teeth 30.

As shown in FIGS. 5A-5D, a fourth embodiment 16 of the device may comprise an elongate monorail 26 and button 24 operatively attached to a button rail carriage 28, the button comprising a pinch clamp 36 housed within and extending from the button 24, wherein the button rail carriage 28 is designed to slide along the elongate monorail, and the pinch clamp 36 is designed to removably engage with a plurality of rail teeth 30 on the monorail 26. Unlike the first three embodiments, the monorail 26 of the fourth embodiment 16 may comprise a base with an elongate protrusion extending upward therefrom and along the length of the base, wherein the button 24 is designed to straddle the monorail. A plurality of teeth 30 may be built into the sides of the elongate protrusion. In embodiments, the teeth 30 may comprise notches, such as square-shaped notches spaced along a length of the monorail 26. The pinch clamp 36 may comprise a pair of upright arms attached to one another by a centrally located crossbar. The upright arms may extend from a first end proximate to the button head to a second end proximate to the monorail 26. The first end of each of the upright arms may comprise a tab extending away from a center of the pinch clamp 36, while the second end of each of the upright arms may comprise a trigger post 38, the trigger post 38 being designed to removably engage with the teeth 30 on the monorail. Thus, as shown in the Figures, when the tabs of the upright arms of the clamp 36 are pressed toward each other, the trigger posts 38 move away from the monorail 26, thus disengaging with the teeth 30 and allowing the rail carriage 28 to freely slide along a length of the monorail 26. On the other hand, when the upright arms of the clamp 36 are in their relaxed state (i.e., when they are not pushed together), the trigger posts 38 may squeeze into the teeth 30 on the monorail 26, locking the button 24 at the desired location.

Figures 6A, 6B, 6C, 6D:
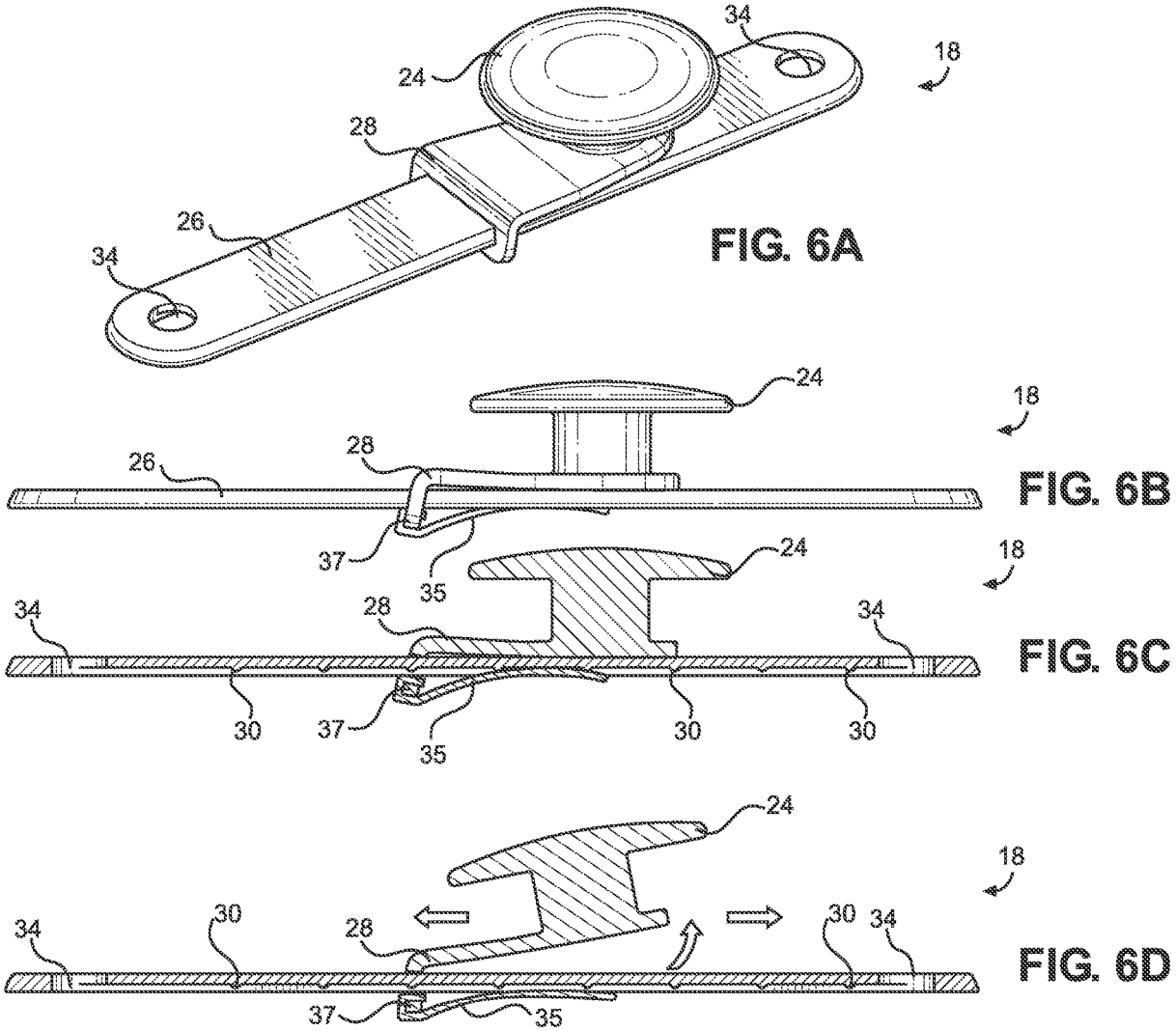
FIG. 6A is a perspective view of a fifth embodiment of the present disclosure.
FIG. 6B is a side view of a fifth embodiment of the present disclosure.
FIG. 6C is a cross-sectional view of the fifth embodiment of the present disclosure, showing button engagement.
FIG. 6D is a cross-sectional view of a fifth embodiment of the present disclosure, showing the button lifted.

As shown in FIGS. 6A-6D, a fifth embodiment 18 of the device may comprise an elongate monorail 26 comprising a substantially flat and wide rail, similar in shape to a tongue depressor, and a button operatively attached to a button rail carriage 28 designed to slide along a length of the monorail 26. As shown in the Figures, the rail carriage 28 may comprise a base on which the button 24 is attached and an angled end at one end of the base. The angled end may include an orifice extending therethrough, wherein the orifice is size to accommodate the monorail 26 passing therethrough. A button clamp 37 may also be attached to the angled end of the rail carriage 28 on an opposite side of the monorail 26 as the button 24. The button clamp 37 may have a hooked end engaged with the orifice on the angled end of the button rail carriage 28 and a clamp arm 35 extending from the hooked end, forming a leaf spring. The clamp arm 35 may removably engage with notches or teeth 30 on a bottom surface of the monorail 26 to removably lock the button 24 in the desired location along a length of the monorail 26. As shown in the Figures, when the button 24 is left in place, the clamp arm 35 engages with the teeth 30. On the other hand, when the button 24 is pulled away from the monorail 26, the rail carriage 28 is able to slide along a length of the monorail 26 to the desired location, as shown in FIG. 6D.

Figures 7A, 7B, 7C, 7D:
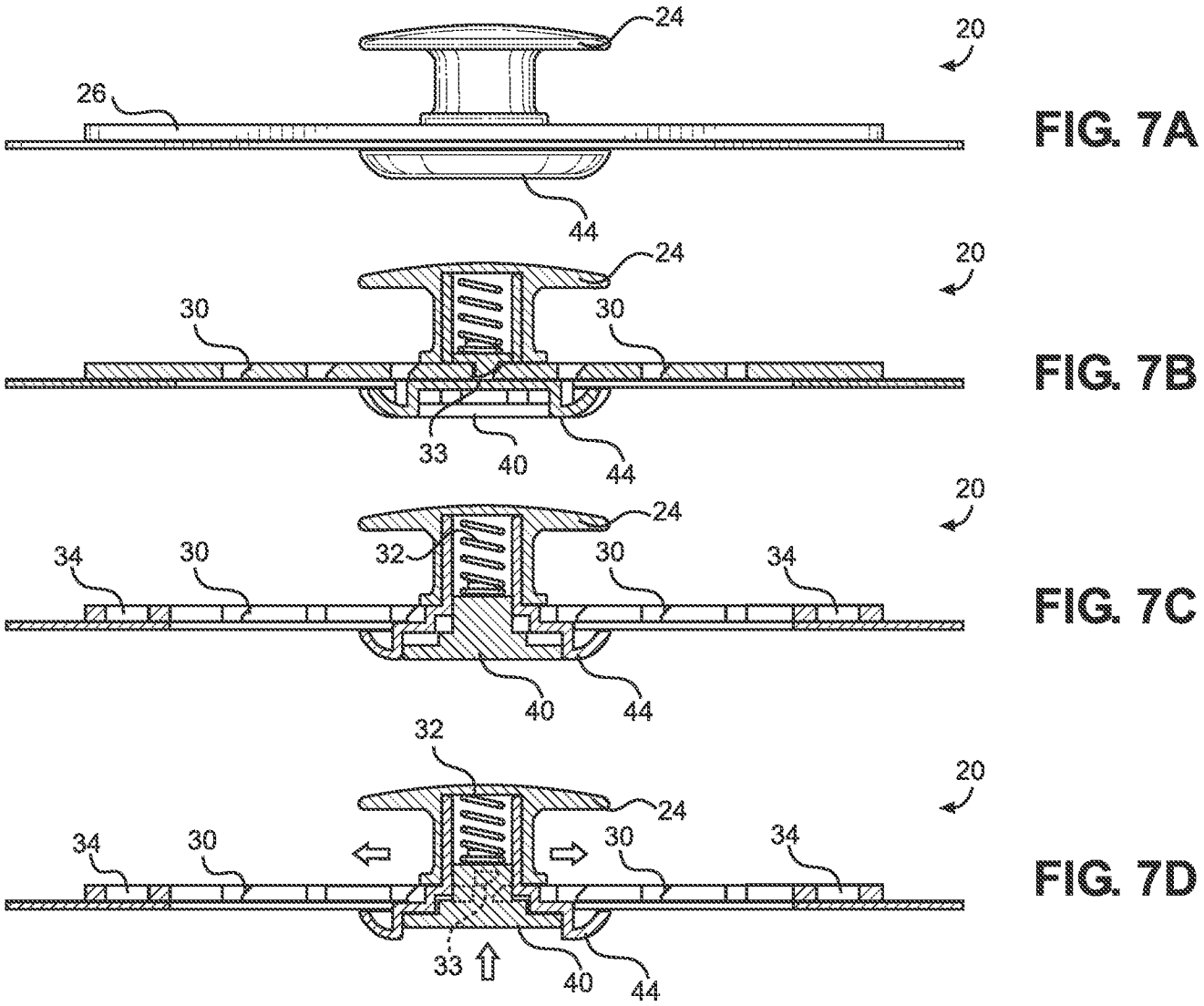
FIG. 7A is a side view of a sixth embodiment of the present disclosure.
FIG. 7B is a cross-sectional view of the sixth embodiment of the present disclosure, showing teeth engagement.
FIG. 7C is a cross-sectional view of the sixth embodiment of the present disclosure, showing button engagement.
FIG. 7D is a cross-sectional view of the sixth embodiment of the present disclosure, showing the button lifted.

A sixth embodiment 20 of the device (FIGS. 7A-7D) comprises a substantially flat, thin, and planar monorail 26 with a central linear orifice extending along a length thereof (like the monorail 26 shown in FIG. 8A) comprising a plurality of monorail teeth 30 spaced along a length thereof and a button 24 operatively attached to a rail carriage 44, the button 24 and rail carriage 44 together housing a centrally located spring 32 and an engagement pin 33 stabilized within an end of the spring 32 proximate to the monorail 26, wherein the engagement pin 33 is designed to removably engage with the teeth 30 on the monorail 26, and the rail carriage 44 extends through the linear orifice in the monorail 26 and is designed to slide along a length of the monorail 26. As shown in FIGS. 7C and 7D, the button 24 may comprise a button head and a hollow button protrusion extending downward therefrom. The rail carriage 44 may comprise a substantially hollow cylinder with an inner cavity, wherein a first end of the cylinder is positioned within the hollow button protrusion and an end of the cylinder distal from the button head has a diameter that increases in a stepwise function. For example, the diameter may increase twice. An end of the rail carriage distal from the button head may comprise rounded tabs extending toward the bottom surface of the monorail 26. The spring 32, such as a compression spring, may be positioned within the inner cavity of the rail carriage proximate to the button head. A push button 40 may be positioned within the end of the rail carriage 44 distal from the button head, wherein an outer surface of the push button 40 is not covered by the rail carriage. The push button 40 may have a shape that closely approximates the inner wall shape of the end of the rail carriage 44 distal from the button head. In other words, the push button 40 may have a largest diameter (or width) distal from the monorail 26, may step down to a first smaller diameter proximate to the monorail 26, and ultimately to a third smaller diameter that is sized to extend through the orifice in the monorail 26 when the push button 40 is pressed toward the monorail 26. As shown, when the push button 40 is pressed toward the monorail 26, the end of the push button closest to the button head contacts and pushes on the engagement pin 33, causing it to disengage with the teeth 30 on the monorail 26 and allowing the rail carriage 44 to freely slide along the length of the monorail 26.

Figure 8A:
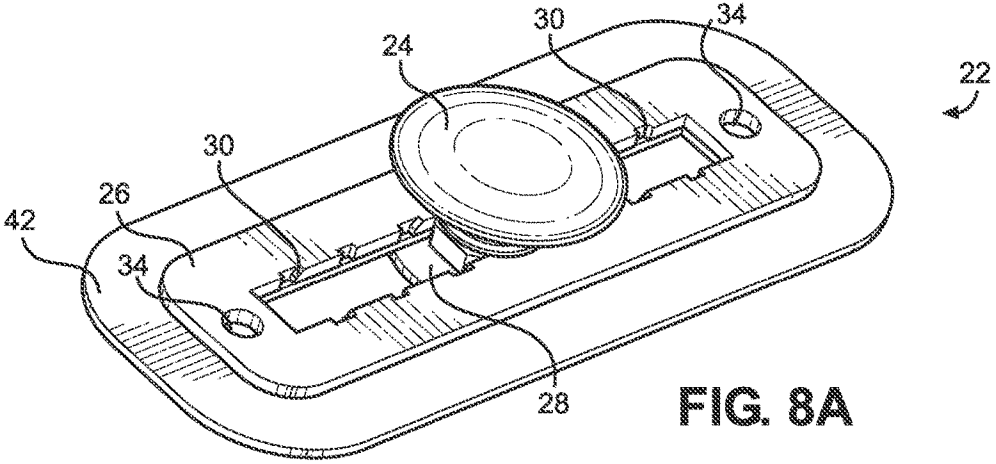
FIG. 8A is a perspective view of a seventh embodiment of the present disclosure.
Figure 8B:
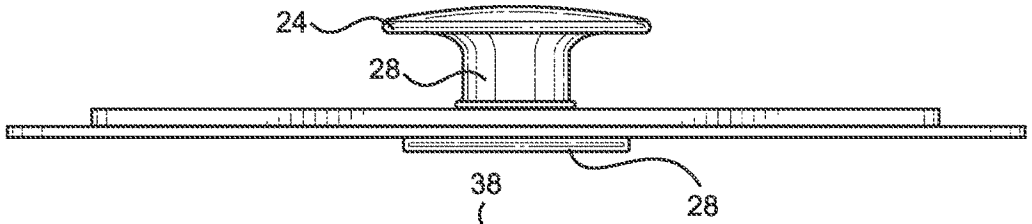
FIG. 8B is a side view of a seventh embodiment of the present disclosure.
Figure 8C:
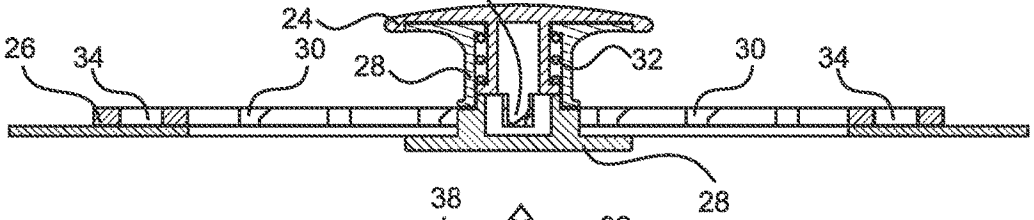
FIG. 8C is a cross-sectional view of a seventh embodiment of the present disclosure, showing button engagement.
Figure 8D:
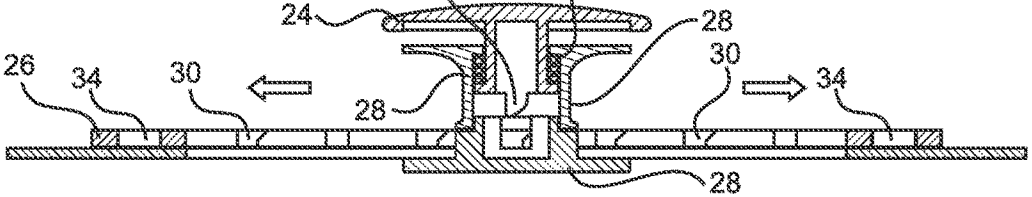
FIG. 8D is a cross-sectional view of a seventh embodiment of the present disclosure, showing the button lifted.

As shown in FIGS. 8A-8D, a seventh embodiment 22 of the device may comprise a monorail track 26 that is elongate and substantially planar with a centrally positioned elongate orifice extending along a portion of a length of the monorail track 26, wherein the monorail track 26 includes a plurality of rail teeth 30 spaced along a length of the monorail track 26, and a button 24 operatively attached to a rail carriage 28 designed to slide along the monorail track 26 within the orifice, the button 24 including a trigger post 38 designed to lock the button 24 and rail carriage 28 in a desired location along the length of the monorail track 26. For example and as shown, the button 24 may comprise a button head and a button protrusion extending downward from the button head toward the monorail track 26, wherein a central portion of the button protrusion may comprise the trigger post 38. An end of the trigger post 38 distal from the button head may comprise a button tooth sized and designed to removably engage with the rail teeth 30. In other embodiments, the button tooth may comprise an engagement pin, such as a substantially cylindrical engagement pin. The rail carriage 28 may extend through the orifice above and below the monorail track 26, wherein a top portion of the rail carriage 28 may be substantially cylindrical and hollow, such that the button protrusion may be accommodated therein. The inner diameter of the top portion of the rail carriage 28 may be larger than an outer diameter of the button protrusion, such that a cavity is formed between the rail carriage 28 and the button protrusion. A topmost surface of the rail carriage 28 may include a lip that extends inward towards and abuts the button protrusion, and a lower most surface of the button protrusion may comprise a lip that extends outward towards and abuts the rail carriage 28, thus closing off a top and bottom of the cavity. A spring 32, such as a compression spring, may be positioned within the cavity. A bottom portion of the rail carriage 28 may comprise a substantially flat cap, which may be substantially circular in some embodiments. The cap may have an extension extending upwards therefrom, wherein the extension passes through the monorail orifice and connects to the top portion of the rail carriage 28. As shown in FIG. 8D, when the button 24 is pulled away from the rail carriage 28, the spring 32 compresses and the button tooth disengages from the rail tooth 30, allowing the rail carriage 28 and the button 24 to slide along a length of the monorail track 26 to the desired location. When the button 24 is released, the spring 32 is in its relaxed state, placing pressure on the lip of the button protrusion and causing the button tooth to press downwards into and engage with a rail tooth 30, thus locking the button 24 into its desired location along the monorail track 26.

The track teeth 30 and the button tooth may have any desired structure allowing them to easily and smoothly engage and disengage with each other. For example, both the track teeth and the button teeth may have a saw tooth structure, which may enable the button to move in a single direction into and along the track for tightening sizes, without the need to utilize the actuator (the pulling or pushing of the button head or the push button or the squeezing of the clamp). Instead of teeth, the device may comprise a pin and hole system, wherein the button includes a pin that is operatively attached to the spring/trigger and the track comprises a plurality of pin holes. When the button is slid along the track, the pin is designed to engage with one of the holes in the track. To disengage the pin, the triggers/springs may be compressed.

The device of the present disclosure may be made of any suitable or desired materials and, in some embodiments, may be designed aesthetically to resemble a conventional garment button. The device may also be available to various sizes, which may be dependent on the intended use of the device. The device may be incorporated into any garment, article of clothing, or item, such as pants, a skirt, a belt, a blouse, a jacket, any other garment, shoes, a bag, or the like that would benefit from an adjustable fit or size. As used herein, the term "pants" may refer to any garment designed to be worn on the lower half of a user's body, wherein the garment is secured to the user's waist via a waistband.

To use the device of the present disclosure, the monorail track 26 with the attached button 24 may be sewn or otherwise attached to the desired item, such as a garment. The button may be slid along the monorail track 26 to its desired position, and then the button 24 may be passed through the button hole on the garment to secure the garment to the user. To adjust the positioning of the button head, the respective actuator may be utilized, whether it be pushing or pulling on the button head, pushing the push button, or pinching the clamp.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A device for adjusting the fit of a garment, the device comprising:

a monorail track with a plurality of rail teeth spaced along a length thereof;

a rail carriage slidably engaged with the monorail track;

a button operatively attached to the rail carriage, wherein the button comprises:

a button head spaced from the monorail track;

a button protrusion extending perpendicularly away from the button head toward the monorail track; and a locking device designed to engage with the plurality of teeth; and a spring compressably engaged with the locking device, such that when the spring is in a relaxed state, the locking device is engaged with a tooth among the plurality of teeth and when the spring is in a compressed state, the locking device is disengaged with the plurality of teeth, allowing the button and rail carriage to slide freely along a length of the monorail track, wherein:

a plane of the a longitudinal length of the button protrusion is perpendicular to a plane of a longitudinal length of the monorail; and the locking device has a plane of motion for engagement and disengagement that is perpendicular to the plane of the longitudinal length of the monorail such that the locking device is configured to move away from the monorail for disengagement.

2. The device of claim 1, wherein:

the monorail track comprises a planar monorail with a central linear orifice extending along a length thereof; and the plurality of monorail teeth are spaced along inner edges of the monorail track along the central linear orifice.

3. The device of claim 2, wherein the locking device is an engagement pin extending from the button head within the button protrusion.

4. The device of claim 3, wherein:

the button and the rail carriage together house the spring, which is a centrally located spring, and the engagement pin, which is stabilized within an end of the spring proximate to the monorail track; and the rail carriage extends through the linear orifice in the monorail track and is designed to slide along a length of the monorail.

5. The device of claim 3, wherein:

the button protrusion is hollow;

the rail carriage comprises a substantially hollow cylinder with an inner cavity;

a first end of the cylinder is positioned within the hollow button protrusion; and an end of the cylinder distal from the button head has a diameter that increases in a stepwise function.

6. The device of claim 5, further comprising a push button positioned within an open end of the rail carriage distal from the button head, the push button being positioned to removably contact the engagement pin.

7. The device of claim 2, wherein the locking device is a trigger post, wherein an end of the trigger post distal from the button head comprises a button tooth.

8. The device of claim 7, wherein a central portion of the button protrusion comprises the trigger post.

9. The device of claim 7, wherein:

a bottom portion of the rail carriage comprises a substantially flat cap configured to close; and the flat cap has a cap extension extending upwards therefrom, wherein the cap extension is configured to pass through the orifice and is configured to connect to a top portion of the rail carriage.

10. A device for adjusting the fit of a garment, the device comprising:

a monorail track with a plurality of rail teeth spaced along a length thereof, the monorail comprising a planar monorail with a central linear orifice extending along a length thereof;

a rail carriage slidably engaged with the monorail track, the rail carriage extending through the central linear orifice above and below the monorail track;

a button operatively attached to the rail carriage, wherein the button comprises:

a button head;

a button protrusion extending from the button head toward the monorail track; and a locking device configured to engage with the plurality of teeth, the locking device comprising a trigger post, wherein an end of the trigger post distal from the button head comprises a button tooth; and a spring configured to be compressably engaged with the locking device, such that when the spring is in a relaxed state, the locking device is engaged with a tooth among the plurality of rail teeth and when the spring is in a compressed state, the locking device is disengaged with the plurality of rail teeth, allowing the button and rail carriage to slide freely along a length of the monorail track, wherein:

the plurality of monorail teeth are spaced along inner edges of the monorail track along the central linear orifice;

a top portion of the rail carriage is substantially cylindrical and hollow and sized to accommodate the button protrusion therein;

an inner diameter of the top portion of the rail carriage is larger than an outer diameter of the button protrusion, such that a cavity is formed between the rail carriage and the button protrusion;

a topmost surface of the rail carriage includes a carriage lip that extends inward towards and abuts the button protrusion;

a lower most surface of the button protrusion comprises a button protrusion lip that extends outward towards and abuts the rail carriage, thus closing off a top and a bottom of the cavity; and the spring is positioned within the cavity.

* * * * *